US010954665B1

(12) United States Patent
Kreizinger

(10) Patent No.: US 10,954,665 B1
(45) Date of Patent: Mar. 23, 2021

(54) SPRAYED-IN-PLACE FRAMED WALL

(71) Applicant: Kenneth Robert Kreizinger, Fort Lauderdale, FL (US)

(72) Inventor: Kenneth Robert Kreizinger, Fort Lauderdale, FL (US)

( * ) Notice: Subject to any disclaimer, the term of this patent is extended or adjusted under 35 U.S.C. 154(b) by 0 days.

(21) Appl. No.: 16/817,798

(22) Filed: Mar. 13, 2020

Related U.S. Application Data

(63) Continuation-in-part of application No. 16/585,863, filed on Sep. 27, 2019, now abandoned.

(60) Provisional application No. 62/900,466, filed on Sep. 14, 2019.

(51) Int. Cl.
*E04B 1/35* (2006.01)
*E04G 11/08* (2006.01)
*E04B 1/74* (2006.01)

(52) U.S. Cl.
CPC ..... *E04B 1/3505* (2013.01); *E04B 1/74* (2013.01); *E04G 11/08* (2013.01)

(58) Field of Classification Search
CPC ..... E04B 2/847; E04B 1/167; E04F 13/02
See application file for complete search history.

(56) References Cited

U.S. PATENT DOCUMENTS 3,744,194 A * 7/1973 Ramberg ..... E04B 1/163 52/378
3,965,635 A * 6/1976 Renkert ..... B28B 19/0053 52/434
4,185,437 A * 1/1980 Robinson ..... E04C 2/384 264/256
4,366,942 A * 1/1983 Michienzi ..... E04B 2/845 249/210
4,472,919 A * 9/1984 Nourse ..... E04C 2/06 52/309.16
4,531,338 A * 7/1985 Donatt ..... E04F 13/0816 29/460
4,565,661 A * 1/1986 Michienzi ..... E04B 2/845 264/34
4,619,032 A * 10/1986 Sudrabin ..... E04B 1/04 264/263
4,678,157 A * 7/1987 Fondiller ..... B28B 1/32 249/65
4,885,884 A * 12/1989 Schilger ..... E04B 5/04 52/354
4,909,007 A * 3/1990 Bodnar ..... E04B 5/04 52/356
4,930,278 A * 6/1990 Staresina ..... E04C 2/28 52/315
5,803,964 A * 9/1998 Scarborough ..... E04B 1/161 106/724

(Continued)

FOREIGN PATENT DOCUMENTS

CA 2886517 A1 * 3/2014 ..... E04C 2/384

*Primary Examiner* — Adriana Figueroa

(57) ABSTRACT

A sprayed-in-place framed wall is disclosed, comprised of a cementitious face and backing layers and a polyurethane foam insulation layer that bonds the cementitious layers to a separate wall frame. Stationary walls are constructed by spraying the materials against one-sided, vertical wall forms positioned around an erected, exterior wall frame. The cementitious materials are restrained by stays. The wall forms may have indentations to enable the resulting wall face to have protrusions such as moulding, bands, quoins and cornices, which may be a different color that the surrounding flat wall face.

19 Claims, 6 Drawing Sheets

(56) References Cited

U.S. PATENT DOCUMENTS

| | | | | |
|---|---|---|---|---|
| 6,041,561 | A * | 3/2000 | LeBlang | E04B 1/14 52/234 |
| 9,487,951 | B2 * | 11/2016 | Shaw | E04B 2/84 |
| 2013/0097956 | A1 * | 4/2013 | Francavilla | E04B 1/14 52/424 |

* cited by examiner

SPRAYED-IN-PLACE FRAMED WALL

CROSS REFERENCE TO RELATED APPLICATIONS

This application is a continuation-in-part of application Ser. No. 16/585,863 filed Sep. 27, 2019 and which claims the benefit of the filing date of U.S. Provisional Application No. 62/900,466 filed Sep. 14, 2019 and incorporated herein by reference.

INVENTION BACKGROUND

The inventive subject matter comprises a sprayed-in-place framed wall wherein stationary walls are built by spraying-in-place various materials against one-sided, removable wall forms to create a wall panel and attaching the wall panel to a stationary supporting frame.

Light frame construction is by far the most popular type of construction in the United States because such a frame is a highly efficient, fast, flexible and inexpensive way to provide one of a building's important components. Light frame refers to the well known 2×4 wood or light gauge metal studs used in "stick" construction, i.e. most building components are built on-site as opposed to being prefabricated. An important trend in light frame construction is the use of exterior insulation to greatly improve a building's energy efficiency as demonstrated by EIFS (exterior insulated finishing system).

While erecting an exterior wall frame is fast and efficient, building the rest of the wall is slow and expensive due to a large number of different building products that are attached to the frame layer by layer, especially in an exterior insulated wall. A typical EIFS wall requires eight different building product layers to finish and insulate and each building product has a manufacturer, a distributor and an installer who all markup the product's cost. As a result, a building product may cost several times its manufacturing material and labor costs and take weeks and even months to install all the building products in a EIFS wall.

As such there is a need for a framed exterior wall with exterior insulation that can be easily customized, fully finished and insulated in days while providing meaningful cost savings. Such a system will require vertical integration to reduce costs as well as special materials and methods. Special materials should be multi-functional, such as spray polyurethane foam and/or easily customized, such as formed cementitious materials.

Spray polyurethane foam, aka "spray foam" is by far the most multi-functional building material. Spray foam is well known for its excellent thermal insulation and is a recognized air, vapor and moisture barrier. Moreover, recent discoveries enable spray foam to be much more. Specifically, as disclosed in my U.S. Pat. No. 9,919,499, spray polyurethane foam applied to a backside of a cladding or sheathing and its supporting frame greatly increased the cladding/sheathing's load capacity. The increased load capacity was so great that spray foam alone could have a higher load capacity than 7/16" plywood over the same span. Also disclosed are two applications with the first spraying polyurethane foam against the backside of third party manufactured siding boards to bond the siding to an erected frame. The second application is prefabrication of a composite panel comprised of a coating sprayed face down onto a horizontal form after which a frame is suspended above the coating and spray foam applied to its backside to bond to the coating that expands and bonds the coating to the frame.

In addition, in U.S. Pat. No. 10,294,668 I disclosed that spray polyurethane foam bonded to both the outside edge and sides of adjacent frame members (studs) it can substantially increase the frame member's load capacity. And finally, in U.S. Pat. No. 10,392,802 I disclosed that a sheathing's impact resistance can be greatly increased with a spray polyurethane foam backing on a variety of sheathing materials, including both a 0.25" and a 0.5" thick panels made of magnesium phosphate cement reinforced with fiberglass mesh. Moreover, these patents also disclosed that spray polyurethane foam may be applied to a magnesium phosphate cement or a polyurea coating within minutes of their respective casting.

Given these discoveries, a frame supported spray polyurethane foam is capable of providing almost all functions required for a quality exterior wall panel. In addition to requiring a frame, spray foam must be covered for protection from ultra-violet rays, fire and insects. As such, a frame supported spray foam wall panel requires a weather resistant cladding on its exterior side and a wallboard on its interior side. Moreover, such a wall may be built in place using third party claddings, such as siding boards, or may be prefabricated, i.e. precast, on a horizontal form.

However, neither the use of third party manufactured claddings nor prefabricating a wall is the most efficient and cost effective process. Third party building products cannot be easily customized and dilute vertical integration and precasting cementitious wall panels requires a manufacturing facility with fixed costs as well as added transportation and installation costs.

For example, glass fiber reinforced concrete (GFRC) is a precast manufacturing process wherein a chopper gun is used to spray a cement based material mixed with 4% to 6% glass fibers onto a generally horizontal, smooth faced form in a controlled environment. Typically, a thin face layer without fibers is poured or sprayed face down in a form, followed by multiple sprayed passes of a fibrous material with each pass hand rolled so as to consolidate it with prior sprayed material. GFRC is used to build counter-tops, furniture, wall panels, roof and ceiling panels and much more with finished products ranging from 0.25" to 1.5" thick, excluding frame. GFRC is well know in the art to be capable of being sprayed against a vertical form with a form release agent.

Larger objects, such wall or roof panels have a rigid support frame bonded to their backside by embedding one end of steel anchors in the GFRC mix with the other end welded to a steel frame. The anchor's purpose is to support the panel during handling, shipping and installation. The GFRC wall panels are typically attached to buildings by welding the panel's frame or embedded steel plates to the building's superstructure. Despite being a thin cementitious structure, GFRC is a relatively costly building product due to its controlled manufacturing, shipping and handling processes.

GFRC walls are precast although the material has been used as shotcrete and sprayed against stay-in-place EPS foam board as disclosed in U.S. Pat. No. 6,985,832 (Nasser Saebi). However, no prior art discloses GFRC as sprayed-in-place against removable wall forms that provide a form finished wall face, are in series and supported by a light wall frame structure.

Another cementitious building material is shotcrete and gunite which are well known in the art for placing concrete by spraying it. Instead of pouring concrete into vertical forms and dealing with hydrostatic pressure issues, a much stiffer concrete mix is sprayed with high velocity (60 to 80 mph) in multiple layers against some type of backstop and reinforcement structure. The high velocity causes the concrete to consolidate and stay in place while additional layers are sprayed. Most applications are for stationary, reinforced structures which include elaborate steel reinforcement erected in front of the backstop and embedded in the sprayed concrete. The processes are used to build swimming pools, retaining walls, tunnel walls, and specialty building walls. When used for building walls the concrete is typically sprayed against a stay-in-place backstop such as structural concrete insulated panels, foam boards, expanded metal, inflated domes and anything that can withstand the sprayed concrete pressure and which will support the concrete as it is built-up through multiple sprayed layers. In most cases the first sprayed layer or pass of a shotcrete or gunite wall becomes the wall's backside and the wall's face is the last sprayed layer or pass and is trowel finished.

Shotcrete refers to pumping a liquefied concrete mix through a hose and spraying it against some sort of backstop. Gunite refers to pumping a dry concrete mix through a hose and then adding water to the dry mix at the nozzle while it is being sprayed against a backstop. Both systems are costly when used for typical exterior building walls. This is due to the special stay-in-place wall forms that must withstand the high velocity, extensive rebar and the fact the wall surface has to be trowel finished.

Relative to shotcrete and gunite used for free standing or building walls, prior art includes stay-in-place inflatable forms onto which layers of cementitious materials, and in some cases spray foam, are sprayed. See: U.S. Pat. No. 4,155,967 (David B. South et al), U.S. Application #20050210767 (Michael DeFever), U.S application #20050097830 (Philip South) and KR100382270. Also disclosed are several methods of using stay-in-place foam boards or foam structures against which cementitious material is sprayed. See: U.S. Pat. No. 4,292,782 (Dan R. Mulvihill), U.S. Pat. No. 5,803,964 (Walter W. Scarborough), and U.S. Pat. No. 4,288,962 (Harvey H. Kavanaugh). There are also several disclosures wherein various materials such as burlap, plastic sheets, etc., are used as stay-in-place forms or backstops for sprayed concrete. See: U.S. Pat. No. 5,305,576 (Brian C. Giles) and U.S. Pat. No. 4,365,455 (William G. Braine). Finally there are several methods of spraying concrete against the rock walls as a tunnel lining. See: JP2014190147 (Kazunori Nishioka) and KR100894118.

Despite shotcrete and gunite being sprayed processes, no prior art discloses either process as spraying-in-place a relatively thin face layer against a form face of a removable form or spraying-in-place walls to be supported by a separate light wall frame structure.

Another well known type of sprayed cementitious material is sprayed stucco that is typically sprayed onto a existing wall in one or more layers. See: U.S. Pat. No. 7,194,845 (Michael R Belleau) and U.S. Pat. No. 7,204,065 (Basil Naji). It has been shown that various stucco mixes can be quickly sprayed onto a stationary concrete wall, or on expanded metal supported by sheathing or even EIFS foam board nailed to a frame. In all instances such stucco is trowel finished after being sprayed. This is typically done with a low velocity stucco spray gun which are well known in the art. However, there is no prior art constructing a stationary framed wall comprised of a stucco mix sprayed against a form face of a removable form.

The problems to be solved by this inventive subject matter are: first, to design a fast and efficient, vertically integrated "stick built" construction process that minimizes materials, uses raw materials and a light frame structure. Second, incorporate an exterior insulation system that is faster and costs far less than traditional EIFS. Third, enable cementitious material to be sprayed against and remain clinging to a vertical, removable form until the material has hardened and the form removed. Fourth, develop a fast, efficient, reusable and versatile wall forming system. Fifth, provide a variety of exterior wall face designs, and sixth, enable multi-colored cast stone designs to be incorporated into the exterior wall face.

SUMMARY OF INVENTION

The inventive subject matter comprises a sprayed-in-place, exterior insulated building system wherein thin stationary wall panels are sprayed-in-place against one-sided removable wall forms and then attached to a stationary frame on the wall panel's backside to construct a framed wall. The system is based on light frame construction and minimizes the use of other wall materials in a fast, efficient and low cost vertically integrated "stick built" process. Raw materials are job-site mixed to create a thin wall panel comprised of a cementitious face and backing layers and a foam insulating layer which are sprayed against a removable form. The insulating layer may be sprayed into an open space exterior to the frame and/or into the frame's cavity. Certain materials enable all three wall panel layers to be sprayed in a day with the forms removed within hours.

The building system's efficiency is based upon vertical integration and multi-functional materials. A first multi-functional material is spray polyurethane foam which is one of the highest quality and most costly insulation materials available—when used only for its insulation. However, when all its other capabilities are used to their fullest extent, it can provide significant construction cost savings. For example, a blanket of typical 2 lb density spray foam can greatly increases the flexural strength of a building frame, its sheathing and cladding, to the point that it eliminates the need for separate sheathing. The foam can also increase the sheathing/cladding's impact resistance as well as provide an air, moisture, water and vapor barrier and its adhesive properties can bond components together at no additional cost. Relative to the water barrier, it is known in the art that continuous polyurethane form can cause the wall panel to have sufficient water-proofing to pass ASTM E331. Exterior foam in that the foam may Given spray foam's multiple functions, the only things missing for an exterior wall are a cladding and a frame.

The cladding is a sprayable cementitious materials that can be sprayed against, temporarily cling to and replicate the texture of vertically positioned wall forms. Cementitious materials have tremendous flexibility in that they can be integrally colored, easily shaped and poured, sprayed or hand laid. New mix designs, fillers and additives can substantially increase their strength and quality to create new applications. The cladding is comprised of a cementitious face and backing layers bonded together in a composite panel that eliminates the need for sheathing. Since cementitious materials are only used for a cladding which is backed by spray polyurethane foam, the cladding may be very thin and thereby use fewer raw materials and be quickly sprayed-in-place.

The frame is based on typical 2×4 wood or light gauge metal studs which is simple and inexpensive as compared to a structural reinforced concrete wall for example. Such a frame allows spray foam to utilize more of its capabilities to strengthen the wall panel and frame. It also enables inserting an open space between a cementitious wall panel and the supporting frame to facilitate the inclusion of exterior, i.e. continuous insulation into a framed wall. An open space can be achieved by embedding one end of a multitude of rigid anchors into the cementitious wall panel and the other end fixed to the light frame.

By utilizing a low-pressure and/or low volume spray-in-place system the form-work needs only to be straight and plumb, have a finished form face, be lightly braced and have a sufficient life to hold down costs. Given a less abrasive cementitious material face layer, the form faces will have a much longer life as compared to highly abrasive shotcrete, for example. The forms also need to be quickly installed and removed and seams efficiently and effectively handled. This is accomplished by lighter and larger interchangeable forms that are quickly braced and connected to one another with tight and conforming seams. The seams may also be addressed using a sandable and easily patchable face layer material that is touched up after form removal.

Spraying or a sprayed wall panel refers to both a process and a structure. As a process, a liquefied material is sprayed, streamed, pumped or similarly cast against a one-sided vertical form or backstop to create a wall. As such spraying, streaming, pumping or otherwise projecting a material against a one-sided wall form is distinguished from casting, placing, pumping or pouring a material in, into or onto a horizontal form or a two sided vertical form. As a structure, a sprayed, streamed or pumped liquefied material is comprised of multiple passes bonding together in a three dimensional configuration of suitable thickness.

Accordingly, one advantage of the inventive subject matter is that utilization of all of a higher quality material's properties can result in using far fewer building materials which reduces cost and speeds construction.

Another advantage is that spray polyurethane foam can be used to reinforce a thin concrete or other cementitious material used as a cladding and/or sheathing.

Another advantage is that a cementitious material made with less abrasive aggregates enable a wall panel face protruding seam to be easily sanded down to blend into the full wall face.

Another advantage is that utilization of a wall frame for load bearing enables a concrete wall face and sheathing to be much thinner and free of steel rebar or wire mesh reinforcement.

Another advantage is that a thin, sprayed-in-place cementitious wall uses few material that are easily transported to and easily mixed on the job-site.

Another advantage is that a continuous insulation and moisture barrier is enabled by using small, spaced apart anchors to attach the concrete wall panel to the frame.

Another advantage is that low pressure and/or low volume sprayed concrete enables the use of thin, lightweight and minimally braced wall forms.

Another advantage is all wall layers can be monolithically sprayed with few or no seams.

Another advantage is robotics may be used to spray the various layers.

Another advantage is a face layer may have a multi-colored appearance created by spraying different colored material(s) in a variety of patterns. For example, several layers of a fine spray can result in a granite appearance.

Another advantage is forms may have three dimensional form faces to create wall face protrusions such as moulding, quoins and bands, which can be a different color than the adjoining flat wall face.

Another advantage is smaller building's cladding, sheathing and insulation layer may all be sprayed and bonded to a frame in a day.

Another advantage is the placement of stays to temporarily support and restrain a thin cementitious wall panel until it hardens and is fixed to a frame.

Other objects, advantages and features of the inventive subject matter will be self evident to those skilled in the art as more thoroughly described below.

DETAILED DESCRIPTION ACCORDING TO THE PREFERRED EMBODIMENTS OF THE PRESENT INVENTION

The inventive subject matter comprises a sprayed-in-place building system wherein stationary walls are sprayed-in-place against one-sided, reusable wall forms to create a wall panel that is attached to a structural, stationary frame to become a framed wall. Such walls may be free-standing walls or for any type of walls within a building structure including interior, exterior and basement walls as long as the wall becomes structurally sufficient to withstand its specified structural loads only after attachment to a supporting frame, which may be attached to another building superstructure component. The sprayed material may be any cementitious and/or insulating material including foamed cementitious material and may comprise one or more layers of sprayed material, which may be reinforced with fibers, mesh or other reinforcement known in the art. Other materials may also be embedded in the sprayed layers including various sheet materials that are bonded to the sprayed material.

Figure 1:
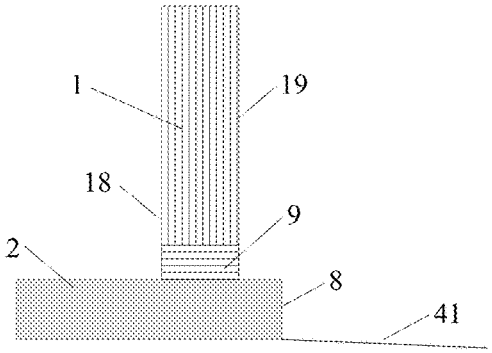
FIG. 1 is a wall frame comprised of a frame member and a bottom plate permanently attached to a floor.

One embodiment of this invention, is a method of constructing a sprayed-in-place wall with at least part of a wall frame positioned before the wall forms are set in place. This process begins with at least part of a wall frame, represented by a frame member 1 and a bottom plate 9 in FIG. 1 which are wood 2×4s in this case. The wall frame is erected and permanently secured to a stationary position on a floor 2, which in this case is sitting on the ground or other surface 41 and the floor 2 has a floor edge 8. The frame members 1 have an interior edge 18 and an exterior edge 19 which becomes the wall frame's interior side and exterior side respectfully. Depending upon the wall frame and building design, the construction process may be easier if some or all frame members are installed after some or all of the wall panel has been sprayed-in-place.

Figure 2:
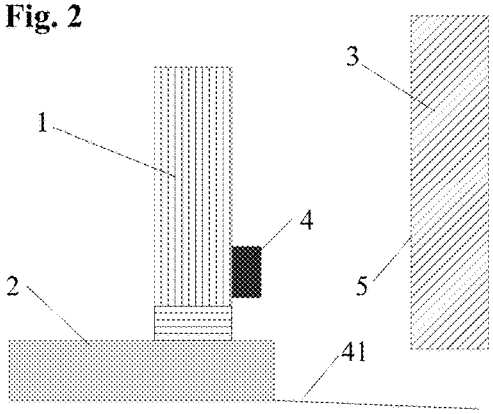
FIG. 2 is the wall frame of FIG. 1 having an anchor fixed to the frame member and a wall form being moved into position.
Figure 3:
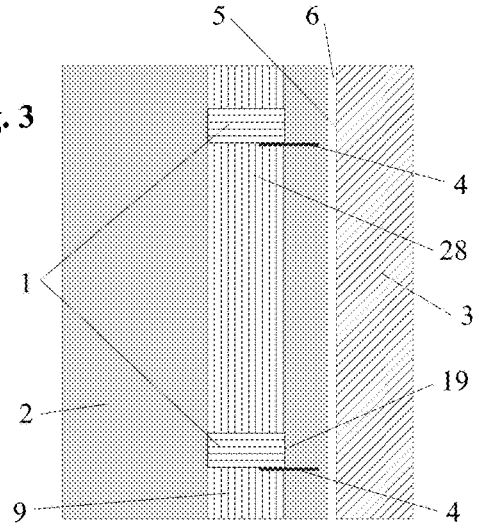
FIG. 3 is a top view of wall frame of FIG. 2 showing two frame members on top of a bottom plate with the wall form in position.

FIG. 2 shows a one-sided wall form 3 having a form face 5 being moved into position and an anchor 4 attached to the frame member 1. One or more anchors 4 may be attached to the frame member 1 at any time before, during or after all of the wall panel's cementitious material layers have been installed. FIG. 3 is a top view of two spaced apart frame members 1 that create a wall cavity 28 in the area between the two frame member's sides. The frame members 1 are on top of a bottom plate 9, which in turn is on top of the floor 2 and the frame members 1 have anchors 4 attached to their sides. Also shown is the frame member's exterior edge 19, which is also the wall frame's exterior side, facing in the direction of and spaced a distance apart from the form face 5. In this case the wall form 3 is resting on the ground and spaced a distance apart from the floor 2 to create a gap 6 between the wall form 3 and the floor 2.

Figure 4:
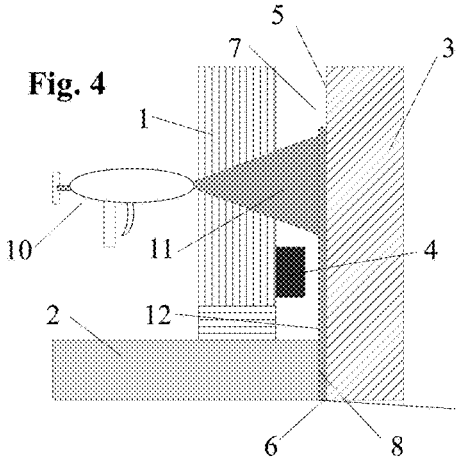
FIG. 4 is a side view of the wall frame of FIG. 3 with a spaced apart wall form being sprayed with a cementitious face layer.

After the wall form 3 is prepared and secured, a first layer of the wall panel 7, known as a face layer 12, is sprayed against the form face 5 of the wall form 3 as shown in FIG. 4. A spray gun 10, pump or other device sprays a face material 11 against the wall form 3 to create a wall panel's 7 face layer 12 which means the resulting wall face was form finished by the form face 5. The face layer 12 is a thin cementitious material of about 0.25" or less thickness and in this case has also been sprayed or poured into the gap 6 between the form 3 and the floor edge 8, which may be thicker than 0.25". Once in the gap 6, the cementitious face layer 12 self-bonds to the floor edge 8 and seals the wall panel 7 to the floor 2. FIG. 4 also shows a space between the face layer 12 and the anchor 4, which may or may not exist in that the anchor 4 may or may not be partially embedded in the face layer 12. However the anchor 4 preferably, is not in direct contact with the form face 5 since the anchor's edge will show through the face layer 12 when the form 3 is removed.

Figure 5:
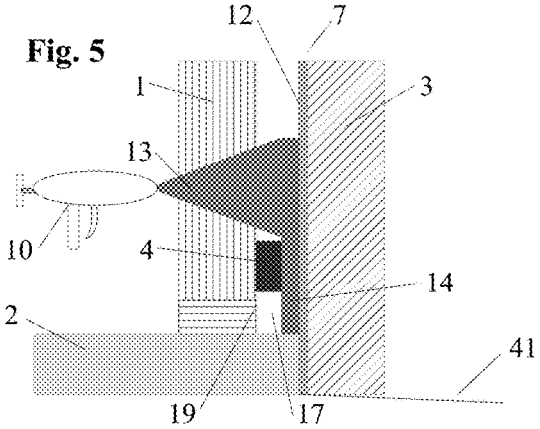
FIG. 5 is the wall frame of FIG. 4 with a cementitious backing layer being sprayed on the backside of the face layer to create a wall panel.

The next step is to spray a backing material 13 against the backside of the face layer 12 as shown in FIG. 5. The backing material 13 is a cementitious material that bonds to the backside of the face layer 12 and to the floor 2 at its bottom and supports the face layer 5 with its thickness and any reinforcement material. The backing material 13 typically contains fibers to reinforce the resulting backing layer 14 which provides much of the wall panel's 7 strength. The backing material 13 may also embed the anchor 4 into the backing layer 14 and thereby creates a rigid attachment of the wall panel 7 to the frame member 1 and thereby to the wall frame.

In one embodiment, the backing layer 14 is spaced a distance apart from the frame member's exterior edge 19, and thereby from the frame, to create an open space 17 between the frame and backing layer. However, a portion of the wall frame may instead be positioned against or partially embedded in the backing layer, although any frame that is more than 50% embedded in the cementitious layers is hereby excluded as a wall frame. There may be multiple backing layers with each comprised of the same or different cementitious material compositions, including the face layer's material composition.

Figure 6:
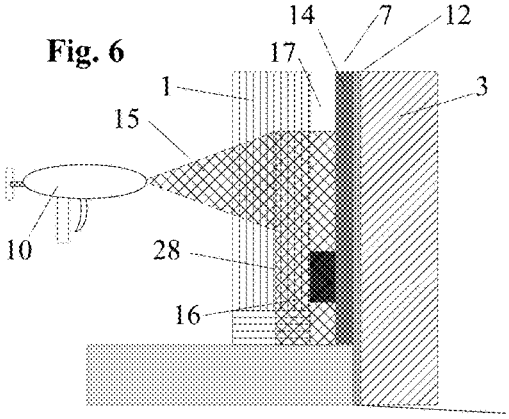
FIG. 6 is the wall panel of FIG. 5 with an insulation layer being sprayed onto the backside of a backing layer and onto the wall frame to fill an open space and part of the wall cavity.

The next step of this configuration is shown in FIG. 6 where an optional insulation material 15 is sprayed on the backside of the backing layer 14, in the open space 17 and in the wall cavity 28 to create an insulation layer 16. As a result, this wall panel 7 is comprised of a cementitious face layer 12 and backing layer 14 and an insulation layer 16, all sprayed-in-place layers. The insulation layer 16 may be sprayed on, and self-bonds to the backside of any prior cementitious layer or membrane. The insulation layer may be continuous through the open space 17, exterior to the frame, from frame member to frame member, and may also fill all or part of the cavity 28 area, which is between the frame member's sides. The insulation layer may be made of any sprayable, self-bonding insulation material and in most cases will be a spray foam such as spray polyurethane foam.

Figure 7:
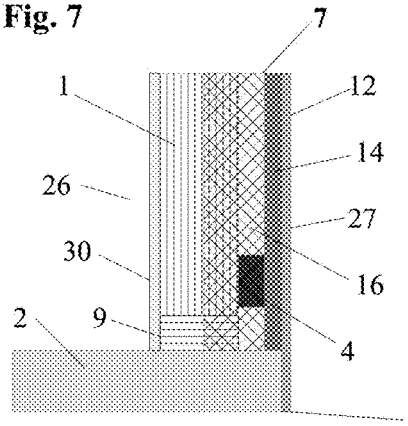
FIG. 7 is a framed sprayed-in-place wall with the wall form removed from FIG. 6 to expose a form finished wall face. Also shown is a wall covering attached to the inside of the frame member.

The next step is for the various wall panel layers to sufficiently harden so the wall form 3 can be removed as shown in FIG. 7. With the wall form 3 removed, the face of a multi-layered, composite wall panel 7 is exposed, attached and supported by a frame member 1 to become a framed, sprayed-in-place wall 26. Typically a wall covering 30 will then be attached to the wall frame's interior side. Unless otherwise stated, a wall panel is a sprayed-in-place wall panel that only becomes a framed wall when its cementitious layers have sufficiently cured, the wall panel is fixed to a supporting frame and the wall forms are removed. Once the wall forms are removed, the frame member's exterior edge 19, which is also the wall frame's exterior side, faces in the direction of and is spaced a distance apart from the wall face 27. As such the wall panel can be any size and shape and even enclose an entire building while being supported by the wall forms on the wall panel's front side and either nothing or the wall frame supporting the wall panel on its backside.

The facing material 11 and backing material 13 may be the same or different cementitious materials and the backing layer may be comprised of one or more layers of different materials. In cases where the materials are different, typically the facing material is colored, facilitates an attractive finish and is weather resistant whereas the backing layer is not colored and has fiber reinforcement. Such face and backing layer materials are well known in the art and used, for example, in various glass fiber reinforced concrete structures such as counter-tops, furniture and decorative panels. However, both the facing and backing layers may be comprised of a wide variety of individual or combined materials.

Testing was conducted using several mix designs sprayed against a vertical, smooth PVC panel as a form with cooking spray as a release agent. In all tests, the sprayed material clung to the form until the sprayed material began to harden, after which the material would slide or fall off the form unless it was held in place by a frame as a brace or with attached anchors or spray foam or an embedded fiberglass mesh that was secured to the top of the form. Polyurethane foam was able to be applied to a wall panel before the face layer hardened by using a magnesium phosphate or a Calcium Sulfoaluminate cement backing layer that cures much faster than the face layer and become sufficiently dry to enable the form to bond.

In another embodiment wall panels may have membranes sprayed onto or within a wall panel layer. A membrane is herein defined as a continuous film over and bonded to the layer on which it is sprayed. Membranes are used to provide additional features to the wall panel such as water-proofing, sufficient to pass ASTM E331 and fire resistance. For example a resin film is sprayed on the backside of a backing layer to provide a water-proof barrier within the wall panel. In those cases where a layer is to be sprayed over the membrane, it must be conducive to enabling the layer to bond to the membrane.

Unless otherwise stated, the term wall panels refers to sprayed-in-place wall panels which are defined as wall frame dependent, stationary walls constructed in-place by spraying one or more layers of material against a one-sided wall form, with the term against meaning both upon and toward, i.e. in the direction of After at least part of a wall panel is sprayed-in-place, it is then attached to a separate wall frame which causes the wall panel to become structurally sufficient to withstand its specified structural loads. Therefore one wall frame function is to cause the wall panel to be structurally sufficient. As such the wall panel is wall frame dependent in that it depends upon an attached wall frame for structural support which occurs both during and after the wall panel's construction. During construction the wall frame provides structural support by being attached to the wall panel before the forms are removed and thereby the wall frame braces, supports and restrains the wall panel's cementitious layers to remain positioned against the forms and/or against one another before they have sufficiently cured and become fixed to the frame.

After construction the wall frame provides structural support by bracing and supporting the wall panel to withstand its specified structural loads and at least prevent the framed wall panel from falling over and/or restraining it from being moved. Specifically excluded from being a wall frame of this invention are frames or frame members that are either not known in the art or are not specifically designated to provide the above described structural support to the wall panel. A sprayed-in-place wall panel is stationary, which means that it is not moved from its position on a floor while being constructed with sprayed material nor after its completion. Wall panels have a front side, which becomes a wall face when a form is removed, and a backside which attaches to a permanently positioned wall frame. A wall panel may be comprised of a single or multiple cementitious layers and may have other materials bonded to one or more of its various layers.

A sprayed-in-place wall panel of this invention will typically have a different material composition than precast or poured materials. For example a sprayed Portland cement mix will generally have a much higher cement to sand ratio, e.g. 50/50, whereas precast or poured panels will have a Portland cement mix of only 10% to 25% cement, and include rock aggregates. Sprayed material will also have a lower water to cement ratio to attain a much lower slump. This is necessary to enable the face and backing layers to remain clinging to a vertical form face or the face layer respectfully rather than slipping downward or falling away. Different material compositions result in different structures.

In addition to different material compositions, sprayed and poured wall panel's materials are also different in how they are consolidated and perform. Specifically, sprayed wall panel material is consolidated by either spray pressure and material velocity from each pass onto prior passes and/or by compressing the sprayed material with roller or trowel. A poured wall's material, on the other hand, has either a low viscosity that self-consolidates or has a higher viscosity that must be vibrated for consolidation. A sprayed cementitious material will also have a greater adhesive strength so sprayed passes adheres to prior, vertically sprayed passes. Sprayed material must also be faster setting to help prevent the material from falling away from the vertical surface.

As a result, all wall panels not built in the resulting framed wall's permanent position on a floor are specifically excluded from being used as a sprayed-in-place framed wall. While this excludes precast or prefabricated wall panels, walls sprayed-in-place as part of a prefabricated building, where the building floor is also prefabricated, are included as being sprayed-in-place framed walls. Also excluded from being a wall panel used as a sprayed-in-place framed wall are structurally sufficient concrete walls which are sprayed-in-place or cast-in-place and are self-supporting due to either embedded reinforcement material or a suitable thickness. A structurally sufficient concrete wall is one that does not require support from an attached or partially embedded light wall frame to meet the wall's structural, load carrying requirement. Embedded reinforcement materials includes steel rebar, welded wire fabric, wire mesh, fibers and any other reinforcing material that is fully embedded in and/or encased by the wall's concrete or other cementitious material. As such, a wall frame or frame members attached to a sprayed-in-place, structurally sufficient concrete wall does not produce a wall frame dependent wall panel.

Unless otherwise stated a floor is herein defined as any generally horizontal surface on top of which a stationary wall frame is erected and permanently attached. As such floors include stationary and prefrabricated building floors and foundations. Floors have a top on which a wall frame sits and a floor edge which is the floor perimeter's vertical face. In some cases the floor edge may be vertically extended to include a supporting beam under the floor or the floor edge may be horizontally extended by a covering such as a decorative tile. A wall panel's cementitious layers may be applied and bond to the floor top and/or the floor edge.

Unless otherwise stated the term wall form shall mean a one-sided wall form which is a form that forms the face of only one side of a wall, herein referred to as a wall face. Wall forms have a form face and may be of any size or shape as long as they are sufficiently vertically oriented, either individually or ganged together, to form all of part of a wall face of at least four feet in height and two feet in length. As such, wall forms may have form faces that are curved, two or three dimensional and even comprise a semi-sphere, for example. A wall form with a two dimensional form face perpendicular to a horizontal floor, will have a vertical height, a horizontal length and a thickness enclosed by a generally horizontal top and bottom and a vertical side edge on both ends of the form's length.

Wall forms are also removable, reusable and have a suitable form face to provide a wall panel's first layer sprayed against the form, i.e. the face layer, with an exposed, form finished wall face. Wall forms are removable to expose the formed cementitious wall face and reusable as sprayed-in-place wall forms so as to spread their cost over a number of uses. A finished wall face is any sprayed-in-place, cementitious wall face produced by a form face of any removable and reusable form.

The wall forms are positioned in place such that the form's face is directed inward towards a permanently positioned wall frame to which the sprayed-in-place wall is to attach or towards the location where the wall frame is to be permanently positioned, in the event the frame is positioned during or after the wall panel has been sprayed-in-place. Wall forms are typically prepared by being cleaned and then having a form release agent applied to the side, although the side may be comprised of a non-stick material. Wall forms are removed after the wall panels have been sprayed, attached to a frame and sufficiently cured, i.e. hardened.

Figure 12:
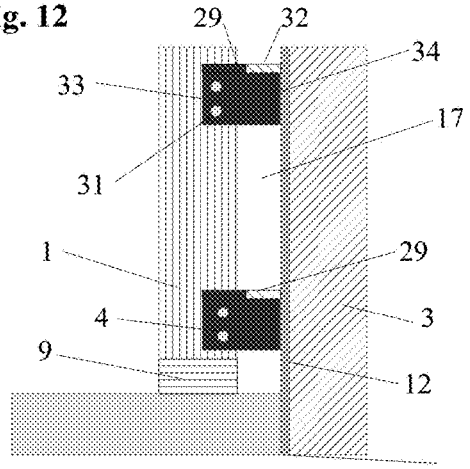
FIG. 12 is a side view of an anchor fixed to a frame member and extending to the face layer and supporting a reinforcement strip.
Figure 13:
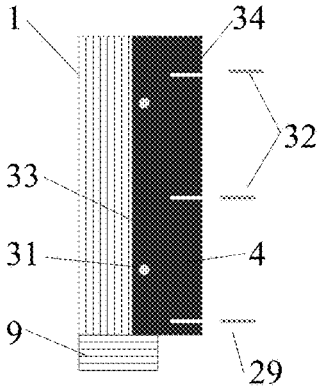
FIG. 13 is a side view of an elongated anchor fixed to a frame member and the anchor has slits at one end for insertion of reinforcement strips.
Figure 14:
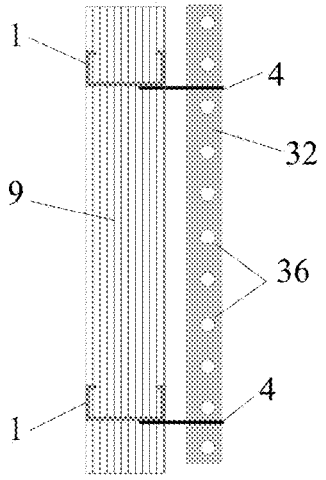
FIG. 14 is a top view of FIG. 13 showing the reinforcement strip with holes to be embedded in a cementitious layer.

In most cases, multiple wall forms are ganged together and/or positioned as a series of forms for a long wall or a continuous wall around a building's perimeter. A series of forms means that a wall is longer than practical for a single wall form and/or the forms are placed at angles to one another to form walls converging at corners, for example. A series of wall forms also indicates there is continuity of a wall face's appearance and a backing layer's reinforcement from form to form. The objective is to create monolithic layers of sprayed material with few or no seams despite spraying against multiple wall forms with seams between them. (As herein defined a cementitious layer is still considered to be monolithic even if an expansion joints separates adjacent cementitious layer sections.) Wall forms are typically butted up together along their vertical side edges to form a straight wall. However, for outside corners, a form may overrun, i.e. extend beyond, an outside corner such that the succeeding form's side edge butts into the prior, overrunning form's form face to create a formed outside corner, as shown in FIGS. 12 to 14. Such a form configuration is still in series since it produces a continuation of a wall's face and backing layer.

For purposes of this disclosure a wall form is defined as an individual form that may or may not be part of a gang form. A gang form is a group of wall forms "ganged" together during the casting, i.e. spraying or handling process. Such gang forms or large individual wall forms are especially cost efficient for multi-story buildings where a gang form may be vertically raised from one floor, after a wall has been sprayed-in-place, to the next floor where a duplicate wall panel is to be sprayed-in-place.

Wall face seams between wall forms may or may not be intentionally exposed for design purposes and expansion joints or hidden through a number of well know methods. Wall forms must provide a continuous finished face across adjacent wall forms and therefore must not have vertical form edges protruding perpendicular from the form face, which would also hinder form removal. Wall forms must also be adequately braced to withstand weather conditions and designed for rapid installation, handling, removal and transportation. Since forms used to prefabricate or precast wall panels do not possess these features, they are specifically excluded as wall forms in this disclosure.

Wall forms also specifically excludes any type of form, backstop or material structure, except a herein defined wall frame, against which a cementitious material is sprayed and thereafter remains in place as part of, or permanently attached to, the resulting wall structure. Examples of such forms, backstops or material structures are cementitious material sprayed against foam boards, expanded metals, sprayed foam, hole in the ground for a basement wall, an embankment, etc. Also excluded are reusable forms used to build domed structures wherein both walls and a roof are formed and sprayed-in-place.

In another embodiment the wall forms may be 3D forms, which are wall forms having indentations or protrusions on their form face and against which cementitious materials is sprayed to create three dimensional wall face shapes. Such shapes include alcoves, recessed and/or protruding bands, molding around window and door openings, quoins, cornices, etc. After the 3D forms are positioned, the construction process is to simply spray a cementitious material face layer against the wall form's shape in the same manner the face layer is sprayed against a wall form having a flat surface. A cementitious backing layer is then sprayed onto the face layer's backside. The face layer sprayed against the wall form's 3D shape may be a different color and/or different material than the color and/or material used as the face layer on other parts of the same or other wall forms. When a wall forms having a 3D protruding shape is sprayed with cementitious layers and then removed, a sprayed-in-place 3D protruding shape is exposed on the wall face.

Figure 8:
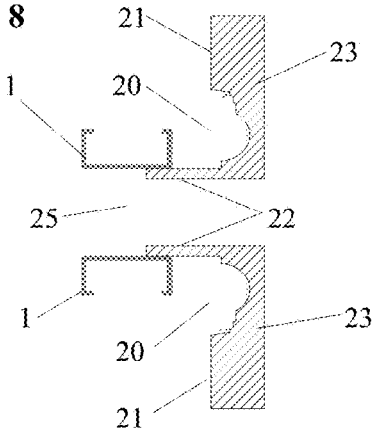
FIG. 8 is a top view of a 3D wall form positioned onto a frame member that frames a window or door opening.

FIG. 8 shows a 3D form 23 positioned in front of two frame members 1 on either side of a window or door opening with part of the 3D form 23 extending to the frame members 1. The frame members 1 are steel studs in this case, which are attached to a top and bottom plate (not shown) and the frame is permanently attached to a floor (not shown). FIG. 8 also shows a molding indentation shape 20 in each 3D form 23 that can be used around the perimeter of a window or door opening. Also shown is a form's flat surface area 21 adjacent to the indentation shape 20 and form returns 22 that connect the 3D forms with the frame members 1.

Figure 9:
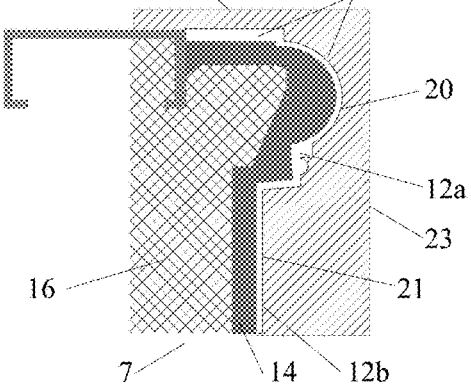
FIG. 9 is an enlargement of the 3D form shown in FIG. 8 on one side of the opening with three layers of a wall panel having been sprayed-in-place.

FIG. 9 shows an enlargement of one side of the FIG. 8 formed opening with three layers of a wall panel 7 having been sprayed against the 3D form 23 and return form 22. The three layers are face layers 12*a* and 12*b*, a backing layer 14 and an insulation layer 16. Of special note is the face layer 12*a*, sprayed against the indentation shape 20 and the return form 22, is a different color and/or material than the face layer 12*b* sprayed against the form's flat surface area 21. This enables colored, cast stone moldings to be sprayed around the perimeter of a window or door opening or for other wall trim and to stand out from the flat wall face material. Since the face layer consisted of two adjacent colors, 12*a* and 12*b*, it may be necessary to mask off part of the 3D form before spraying the first face layer color 12*a* to keep the form area clean in the area where the second face layer color 12*b* is to be sprayed. As an alternative any over spray from the first face layer color 12*a* can be cleaned off the form's face before spraying the second color.

After the face layers 12*a* and 12*b* were sprayed in FIG. 8, the backing layer 14 is sprayed on their respective backsides. This is followed by spraying an insulation layer 16 onto the backing layer's 14 backside. All layers were sprayed against the 3D form or the backside of a prior layer.

Figure 10:
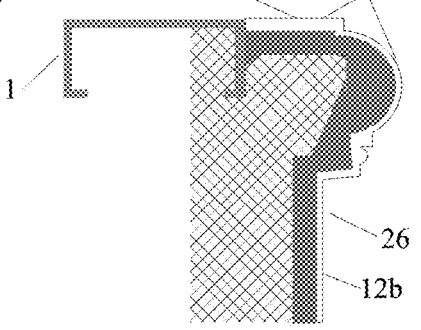
FIG. 10 shows FIG. 9 after the 3D form has been removed to reveal a framed sprayed-in-place wall having a finished face with protruding molding.

FIG. 10 shows FIG. 9 after the 3D form 23 has been removed to expose a sprayed-in-place frame supported wall 26 having two face layer colors 12*a* and 12*b*. Also shown is a face layer return 24 that was created by spraying the first face layer color 12*a* against the form return 22 which is part of the 3D form 23 extending to the frame member 1. Face layer returns 24 are form finished areas typically around window and door openings that are generally perpendicular to the wall face and extend inward from the wall face to the wall frame. Face layer returns 24 basically cover a cross section of the wall's layers at a window or door opening. In some cases the return may consist of a backing layer with the face layer applied on top of the backing layer by a trowel, for example.

Figure 11:
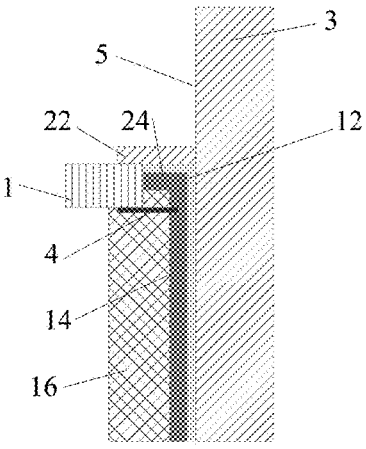
FIG. 11 is a top view of a return form attached to a wall form to create a sprayed wall panel return comprised of a face, backing and insulation layers.

In another embodiment a face layer return 24 is shown in FIG. 11 as created by spraying a face layer 12 against a return form 22 that extends inward from a form face 5 of a wall form 3. The return form 22 may be held in position by fastening to the frame member 1. The face layer return 24 is backed by the backing layer 14 and the insulation layer 16. FIG. 11 is a top view of a wall panel and wall form and also shows the top view of an anchor 4 extending from a side of a frame member 1 to the backing layer 14.

Since 3D forms contain horizontal shapes, such as a top and/or bottom of a molding or band, 3D forms must be horizontally removed after the cementitious layers have sufficiently hardened. As such, the forms are pulled outward from the framed wall before they can be moved vertically.

When used, an anchor's primary purpose is to fix a wall panel to a wall frame and in some cases support the cementitious layers while they are being sprayed and/or hardening, i.e. setting up. To fix a wall panel to a wall frame, either anchors are fixed to frame members and to the wall panel's cementitious layer and/or an insulation layer bonds to the cementitious layer and to the frame. Anchors are comprised of rigid structures that have one end fixed to frame members, and thereby to the frame, by fasteners, adhesives, welding, embedment or other rigid fixation. The anchor's other end is fixed to the cementitious layers by full or partial embedment in one or more layers and/or by fasteners, adhesives or other rigid fixation. Rigid round bars such as studs that require holes to be drilled into a cementitious backing layer as part of their attachment to the backing layer are excluded as anchors of this invention. Anchors may also be fixed to cementitious layers by being bonded to a self-bonding spray foam insulation layer that is in turn bonds to the cementitious layer. The attachment, strength and rigidity of the anchors must be such that its fixation to the wall frame restrains a wall panel's movement.

Anchors may be smaller structures, spaced a distance apart as shown in FIG. 2, or anchors may be much larger structures and serve other purposes. For example, FIG. 12 shows an anchor 4 with its first end 33 fixed with fasteners 31 to the side of a frame member 1 acting as a stud, and its second end 34 having holes to enable a cementitious material to bond to itself through the holes when the anchor 4 is embedded in it. This creates a much greater fixation between the wall frame and wall panel and substantially increases the wall's structural integrity by making the wall panel part of the wall frame.

In another embodiment, wall panel reinforcement strips may be supported by anchors. FIG. 12 shows reinforcement strips 32 resting on top of anchors 4 prior to a backing layer and insulation layer sprayed-in-place. The reinforcement strips may be used for a number of purposes, including to reinforce the backing layer and/or the insulation layer and to prevent any of the layer's material from sagging or running downward while still wet. Strips may also minimize a framed wall's thermal expansion and contraction by virtue of bonding a wall panel layer to a reinforcement strip made of material less susceptible to such expansion and contraction. Reinforcement strips may be made of any elongated material and be rectangular, round or any other cross section shape.

In another embodiment FIG. 13 shows an anchor 4 with its first end 33 fixed to a frame member 1 with fasteners 31 and its second end 34 having slits 35. The slits 35 support reinforcement strips 32 that slip into the slits 35. Such horizontal reinforcement strips 32 may be embedded into a cementitious layer(s) and/or a spray polyurethane foam insulation layer to greatly increase the lateral load capacity of a framed wall. In addition, since the slits 35 prevent the reinforcement strip 32 from moving away from a face and/or backing layer, the reinforcement strip 32 is also a stay 29 that restrain a face and backing layers from movement away from a form.

Figure 15:
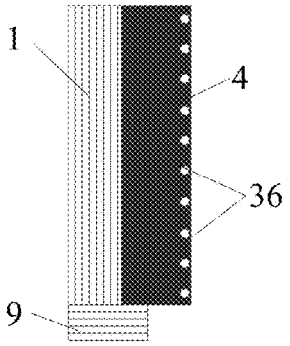
FIG. 15 is another side view of an elongated anchor with holes to embed into a cementitious layer and fixed to a frame member.

FIG. 14 shows a top view of FIG. 13 showing the reinforcement strip having holes 36 to enable the sprayed material to bond to itself through the holes and thereby be more thoroughly bonded to the cementitious or sprayed foam layers. Of course the anchors 4 themselves may also have such holes 36 for embedment as shown in FIG. 15.

A wall frame is any rigid, stationary frame structure formed of relatively slender, lightweight and spaced apart sections herein referred to as frame members. Individual frame members may be of any shape although are generally rectangular, elongated and have two ends, an interior edge and an exterior edge that are generally parallel to the wall panel and other wall covering and two or more sides that are generally perpendicular to the wall panel and wall covering. As such a wall frame has an interior side, comprised of frame member's interior edges, and an exterior side comprised of frame member's exterior edges. As used herein, a wall frame is comprised of multiple frame members that support a wall panel attached to their exterior edge and/or sides while supporting a wall covering attached to their interior edge. Steel rebar or a rebar cage is not a frame member in and of itself although rebar can be used to reinforce a cementitious frame member. Frames or frame members used solely to support embedded rebar, wire fabric and/or mesh are specifically excluded as being a wall frame of this invention.

Since wall coverings are typically attached at a later stage in the construction process, a wall frame intended to support a wall covering is herein considered as though it is presently supporting a wall covering. As such, a "wall covering attached" or "attaching a wall covering" means that a wall covering is either attached at that time or is planned to be attached at some future date. A wall frame's interior edge has wall covering(s) attached and its exterior edge and/or side has a wall panel attached. Frame members may or may not be in direct contact with one another to form a wall frame.

Wall frames, and thereby their frame members, are permanently attached to one or more superstructure components. For example a wall frame consisting of frame members comprised of 2×4 studs and a top and bottom plate, is permanently attached to a floor on the wall frame's bottom and a ceiling or roof structure on the wall frame's top. Superstructure components are herein defined as foundations, load bearing walls, floor structures, ceiling structures, roof structures, columns and beams and the like. When used on structural steel or reinforced concrete framed structures, a wall frame may be attached to a concrete floor on the wall frame's bottom, a column on both horizontal ends and a beam over the wall frame's top, for example.

Wall frames and frame members are light frame, typically wood or metal but may be comprised of cementitious materials. They are generally well known in the art 2×4s or 2×6s, but may be smaller or larger sized members. Steel frame members are cold-formed with a 12 gauge (7⁄64") maximum material thickness. Specifically excluded are wall frames consisting of structural steel, i.e. hot rolled, and/or frame members having sections thicker than 12 gauge (7⁄64"), although a framed wall may be attached to such structural steel. Light frame cementitious frame members may have embedded reinforcement materials, although any cementitious frame member with a cross section wider than 6" is hereby excluded. Wall frames purpose is to support wall coverings and wall panels attached to their interior and exterior edges respectfully, primarily from lateral and/or horizontal loads, although they may also be load bearing, which means the wall frame may also support a vertical load such as a ceiling or roof. Frame members may be of any cross section shape and be vertically, horizontally and/or diagonally oriented with their ends either connected to other frame members, such as top of bottom plates, or the ends may be connected directly to superstructure components.

Figure 16:
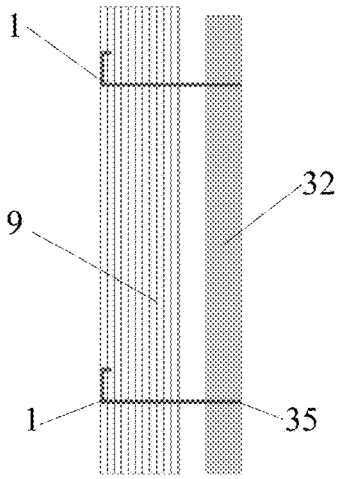
FIG. 16 is a top view of frame members shaped to have an exterior edge that supports reinforcement strips and extends to the cementitious layers.

In another embodiment, frame members may have a variety of shapes and may be shaped to incorporate an anchor and thereby used as a substitution for anchors. For example FIG. 16 is a top view of a frame comprised of two frame members 1 on a bottom plate 9, with the frame member's shaped to have a thin exterior side 19. The frame member's side 37 that extends outward from the frame and supports a reinforcement strip 32 inserted into slits 35 in the frame member's extended side 37.

Wall frames may be positioned on a floor before, during or after the cementitious layers are sprayed-in-place. For example, wall forms are set in place near a floor, prepared and then sprayed with a face layer, after which a wall frame is positioned and permanently attached to the floor. Or, in another example, a wall frame is positioned and permanently attached to the floor after spraying both cementitious layers. In essence, the wall frame may be positioned and permanently attached to the floor at any time before, during or after the cementitious layers are sprayed. However, in all cases the wall frame must be stationarily positioned, i.e. placed in its stationary location on the floor, before a wall panel is fixed to the wall frame. Regardless of when a wall frame is permanently secured to the floor, the wall frame is positioned such that its exterior side faces in the direction of the form face and is spaced a distance apart from the form face or from the position where the form face is to be placed. It is in this space between the frame's exterior side and the wall form face that the wall panel cementitious layers are to be built and any open space exist.

Figure 17:
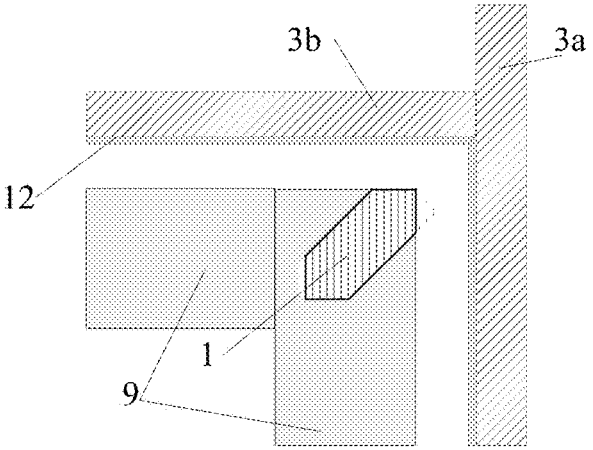
FIG. 17 is a top view of a an outside corner formed by two wall forms on which a face layer has been sprayed. Also shown is a corner frame member attached to a bottom plate.

In some embodiments part of a wall frame is installed before spraying the face and/or backing layer(s) and part of the frame installed after. FIG. 17 shows a formed outside corner with forms 3*a*, over-running the planned wall panel and form 3*b* butting into the form face of wall form 3*a*. This enables greater form flexibility since longer forms may be used instead of requiring forms to match the wall panel's exact length. Also shown is a frame member 1 positioned at a 45° angle in the corner and sitting on a bottom plate 30. As such, there is minimal obstacles to spray the face layer 12 around the frame member 1. This results in spraying around fewer obstacles and for better access to spray hard to reach areas such as molding indentations in 3D forms and outside corners.

Figure 18:
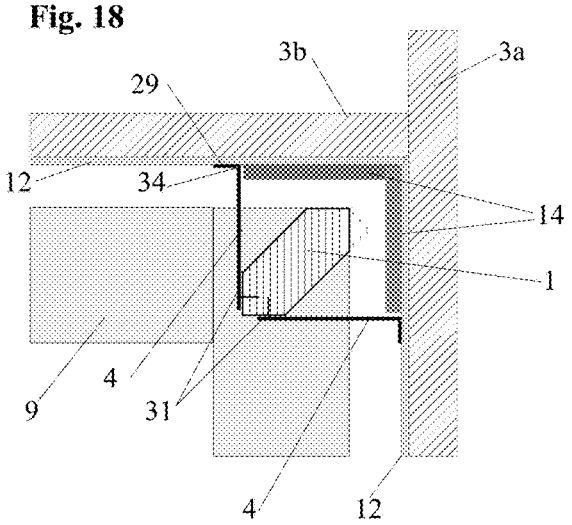
FIG. 18 is FIG. 17 with an added partially sprayed backing layer and two anchors fixed to the corner frame member.
Figure 19:
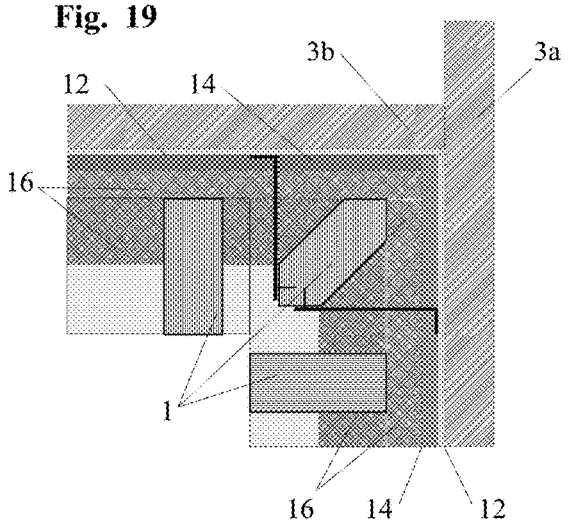
FIG. 19 is FIG. 18 with the backing layer fully sprayed-in-place, installation of two more frame members and a sprayed insulation layer that bonds to the backing layer and to the frame members.
Figure 20:
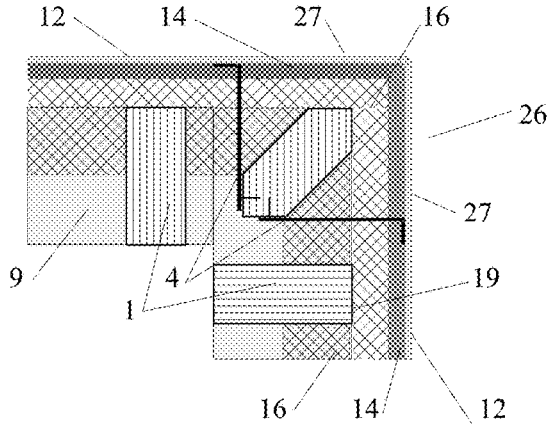
FIG. 20 is FIG. 19 with the wall forms removed for an exposed, form finished wall face.

FIG. 18 is the same as FIG. 17 except part of the backing layer 14 has been sprayed behind the frame member 1 and two anchors 4 have been positioned with a first end and attached to the frame member with fasteners 31 and the anchor's second end 34 is bent 90° to function as a stay 29 and restrain the face layer 12 from movement. FIG. 19 shows FIG. 18 with the backing layer 14 completed, the missing frame members 1 installed and the insulation layer 16 sprayed-in-place. As a result, one or more frame members are installed into the wall frame after the face layer is sprayed-in-place. FIG. 20 shows the completed wall panel of FIG. 19 as attached to the frame to comprise a sprayed-in-place frame supported wall 26 wrapping an outside corner. Once the wall forms are removed, the frame member's exterior edge 19, which is also the wall frame's exterior side, faces in the direction of and spaced a distance apart from the wall face 27.

Wall covering herein refers to any material or combination of materials that attaches to an interior edge of frame members, i.e. studs, in a typical manner known in the art and that covers the interior side of a wall frame. This includes all panels, sheets, plaster, stucco, fabrics, wall boards, cementitious materials, etc. that are typically nailed, screwed or glued to a frame member's interior edge and wide enough for adjacent panels to be attached to the same frame member.

The wall panel layers are bonded together by adhesion or cohesion. Typically with with a layer of spray polyurethane foam as an insulation layer. Adhesion is the action or process of adhering, i.e. sticking fast to a surface or substance and cohesion is like molecules sticking together, such as two layers having the same binder although different filler materials. Bond, bonded or bonding, as used herein, shall only refer to a permanent, i.e. long lasting adhesive or cohesive bond. To adhere or self-adhere means to temporarily attach, stick fast, cleave or cling regardless of whether or not adhesion or cohesion are involved.

A binder is any material or substance that holds or draws other materials together to form a cohesive whole by adhesion or cohesion and hardens into a solid. Binders are typically liquefied cast materials and include polymers, resins, Portland cement and phosphate cements for example. A cementitious material is herein defined as a liquefied, i.e. liquid or semi-liquid, binder with or without a filler that is sprayable, self-bonds or self-adheres to most construction related materials it comes in contact with when sprayed and solidifies at some point after being sprayed. Cements are herein defined as a type of cementitious materials used in the construction industry to build walls and/or structural components and include such binders as Portland cement, calcium aluminate, calcium sulphoaluminate, various phosphate cements, etc. that are mixed with a liquid and with aggregates such as sand, small rocks and calcium carbonate, for example. Spray foam insulation material is specifically excluded as a cementitious material to distinguish it from the face and backing cementitious layers. A filler can be any type of material aggregate, fragments or particles. Cementitious materials may be reinforced by various methods and materials known in the art and may have various additives mixed in.

Both the face and backing layers begin as liquid or semi-liquid cementitious materials that are sprayed against, i.e. upon or towards a wall form's form face, with the face layer sprayed directly upon the form face and the backing layer sprayed onto the backside of the face layer and toward the form face. The face layer is typically 0.25" or less in thickness, colored and made of materials more conducive to producing an attractive wall face and the ability to withstand weather, sun, cracking and minor impacts, etc. While a wall form's form face will have either an applied release agent or a non-stick surface, a sprayed face layer must be able to temporarily self-adhere to the release agent and/or form face against which it is sprayed and then release once it has sufficiently hardened. A sprayed face layer's composition will have a higher percentage of binder to filler, typically 20% to 60% binder, which is more than the composition of a similar poured material. Unlike a similar poured material, a sprayed face layer will also have a binder or additive to increase durability and/or accelerated setting, i.e. hardening.

A backing layer supports the face layer and may be comprised of more than one type of cementitious material layer. Backing layers provide thickness to the cementitious layers and are therefore typically thicker than the face layer, contain fiber reinforcement, larger aggregates and are typically not colored. In some cases the face layer and backing layer may consist of the same material composition and since the face layer is typically 0.25" or less in thickness, any face layer thickness in excess of 0.25" is a backing layer. While backing layers may be of any cementitious material, they are primarily sprayed concretes comprised of aggregates and additives mixed with cements such as Portland, calcium aluminate, calcium sulfoaluminate, magnesium phosphate and more. Sprayed backing layers material composition includes having have some type of accelerated setting additive or binder as well as an additive or binder that enables self-bonding to the face layer. As used herein, a layer comprises the total thickness of a cementitious or insulation material as opposed to sprayed passes that describe building up a layer's thickness by making multiple passes of a sprayed material. Also excluded as a layer are small, concentrated, sporadic areas where a backing material is used to bond an anchor or a stay to the backing layer, for example.

In another embodiment, a wall panel's cementitious face and backing layers combine to a thickness of 2" or less and more preferable to be 1.5" or less and still more preferable to be 1" or less even more preferable to be 0.6" or less and most preferable to be 0.4" or less in thickness. The layers are thickened by being sprayed in passes that have a tendency to run downward against a vertical form face or prior pass and cause the face layer to slip down or fall away from the form face. Once the face layer is pulled away from the form face, it is difficult to repair and therefore steps must be taken to restrain the face layer against the form face. As such special precautions are necessary to ensure such a thin wall panel's face and backing layers stay in place against a form face until the form is removed.

A stay is herein defined as any object and/or material composition used to restrain a face layer in its established position against a form face or a backing layer against the backside of the face layer, until the form is removed. A stay helps ensure a higher quality framed wall in that it prevents a face layer from moving out of position, separating from against a form face and resulting in a defective wall face. A stay may also be used to prevent a backing layer from separating from the face layer, resulting in a weaker wall panel. Examples of such stay objects include: frame members, anchors (including built up materials), reinforcement strips, wedges, braces and mesh/grids which may be embedded in or positioned on the backside of a face and/or backing layer. For example FIG. 12 shows both an anchor 4 and a reinforcement strip 32 being used as stays 29. Since the anchor is pressed against the face layer 12, it is restraining the face layer from moving away from a form face. In addition, a reinforcement strip 29 is locked in its horizontal position by a notch in the top of an anchor 4, causing the strip to restrain the face layer 12 from moving away from the form face. Object stays may also be positioned before or after a face layer is sprayed, as long as the stay does not interfere with the form face having full or almost full sprayed material coverage.

Object stays also include pins, screws, clips, etc. that are inserted thru the form to grip the face layer in some manner. For example a screw may be inserted thru a form from its outside such that the screw's is becomes exposed on the form face and extends into the face layer. When the forms are ready for removal, the screw in removed and the face layer is no longer gripped by the screw tip.

A form face is another object that may be used as a stay when its material composition, texture and/or shape is used to restrain a face layer against the form face. For example a 3D form may have protrusions or indentations of the form face that supports a face layer by giving it something to cling to. A form face may have a fussy texture to which a face layer can cling or a form face may not be made of a non-stick material such as silicone.

Material compositions as a stay includes both a face and/or backing layer's composition and any form release agent or other material applied to a form face before spraying a face layer. For example Pam cooking spray, when applied to a form face as a release agent, causes a sprayed cementitious material to temporarily adhere to it until such time as the Pam and/or the face layer dry out. In this case as one or both the cementitious and release agent materials change, the ability of the cementitious material to adhere to the release agent decreased. In another example, the higher the viscosity of a sprayed material, the less likely it is to flow downward along a vertical form and thereby more quickly establish its final position against a form face. Another example is using a higher concentration of an adhesive additive in a face or backing layer to increase its its ability to adhere to a release agent or a non-stick form face. The importance of using a form face and/or a material composition as a stay is that it enables at least the face layer to be sprayed without having to contend with spraying around a frame and thereby makes spraying much faster which reduces costs.

Some stays may also provide long term wall panel reinforcement. For example a 1.5" wide flat metal horizontal strip may be embedded in the backing and the insulation layers and stiffen both layers against wind loads. Regardless of whether a stay provides long term wall panel reinforcement, its temporary face layer restraint ensures the wall panel has a form finished wall face. This describes the wall face as having both a texture and shape provided by the form, which is only possible if the face layer is retrained against the form until the face layer is hardened and the form is removed. Without a stay restraining the face layer, part of the face layer may pull away from the form and warp, crack or fall apart, resulting in a wall panel having a wall face that was not form finished.

An insulating layer is different from a cementitious layer and may be comprised of any one or more recognized insulating materials that may be sprayed or poured into any open space between the frame member's exterior edge and the backside of the last cementitious layer and optionally into the wall frame cavity. A sprayed insulating material is any sprayed, self-bonding material that has a 1.0 or greater R-value. Unless otherwise noted, spray polyurethane foam referenced herein is any self-bonding, liquid applied foam, made from polyurethane, polyisocyanurate or other chemicals in whole or in part, that may be sprayed, expands and self-bonds to materials it comes in contact while the foam is expanding. Spray polyurethane foam may be open or closed cell and has a density of less than eight pounds per cubic foot and more preferably less than 4 pounds per cubic foot and even more preferably less than 2.5 pounds per cubic foot.

An insulation layer may be bonded to both a backside of a cementitious layer and to a frame in order to fix the frame to the wall panel as long as the insulating layer has a bonding strength sufficient to create a rigid framed wall panel structure. Closed cell, spray polyurethane foam having a two pound or greater density is one such insulating material that will cause the framed wall to be sufficiently rigid.

In another embodiment, an insulating layer may also be poured when a form is positioned between the sides of adjacent frame members. For example cardboard may be wedged or attached to the sides of adjacent studs, and thereby spaced a distance from a backing layer to create an open space, and a foam or other material poured into the open space.

In another embodiment mesh may be embedded in one or more wall panel layers for reinforcement. Mesh is herein defined to include grids and any type of rigid sheet material filled with numerous holes in close proximity such as a pegboard. For example any type of mesh may be positioned on the backside of a sprayed cementitious pass and then embedded into the layer by a subsequent cementitious pass that is able to bond, through the holes, to a prior pass on the opposite side of the mesh. A mesh may also be embedded on the backside of a layer by spraying a subsequent layer on the mesh's backside. A mesh may be positioned in the open space between the frame member and the last cementitious layer and sprayed with spray polyurethane foam that permeates the mesh while the foam bonds to the mesh, the cementitious layer and the wall frame. Such a mesh may also be secured to and hung from the top of a frame or form and once embedded in a layer, may help to restrain the layer(s) in a vertical position against the form.

Figure 21:
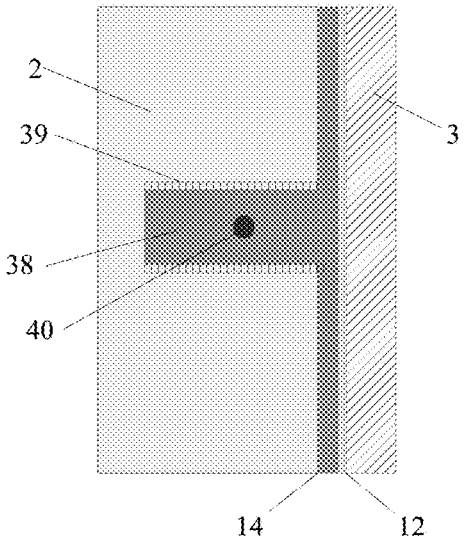
FIG. 21 is a top view of a cementitious rib sprayed or poured in a cementitious rib form.

In another embodiment a wall frame may be comprised of cementitious ribs sprayed against the backside of the cementitious layers. FIG. 21 shows a vertical cementitious rib 38 sprayed or poured into a cementitious rib form 39 that may be removable or stay-in-place. Also shown is rebar 40 that is embedded in the floor 2 to fix the cementitious rib 38 to the floor 2 while also reinforcing the cementitious rib 38. Such cementitious ribs 38 may also have their backside partially formed such that the cementitious ribs are intermittently bonded to the cementitious layers so that some amount of an insulating layer may exist between the ribs and cementitious layers.

In another embodiment, 3D forms may be part of a larger wall form that also forms a wall panel's flat surface area 21 as shown in FIG. 9 or the 3D form may be an individual form that only forms a protruding or recessed area of a wall panel such as window or door moulding. As an individual protruding or recessed area form a 3D form may: (1) be erected and sprayed during the same general time that adjacent flat surface area forms are erected and sprayed; (2) be erected and sprayed after an adjacent formed flat surface area has been sprayed and the forms removed: or (3) be erected on and/or adjacent to any flat surface area produced by any process or material and then sprayed-in-place. A wall panel's flat surface area is defined as the vertical surface of the majority of a wall face and may be smooth, textured—including any type of stucco textured finish, or have any designed shape such as those produced by concrete form liners.

Figure 22:
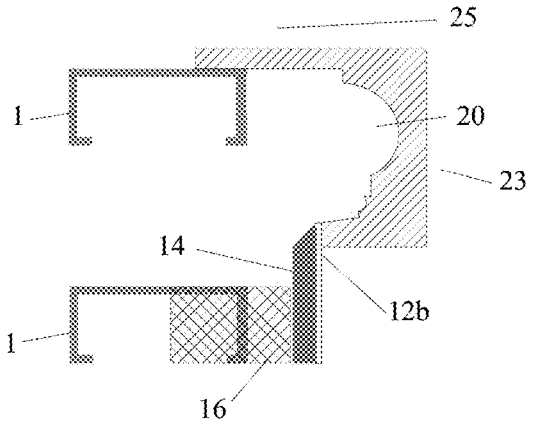
FIG. 22 is an individual 3D form with an indentation shape forming a window or door moulding on one side of a window or door opening.
Figure 23:
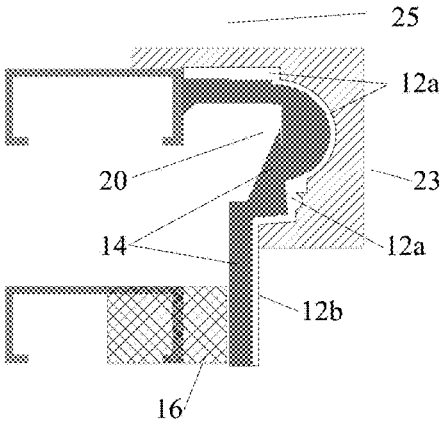
FIG. 23 is FIG. 22 with the moulding's face and backing layers sprayed into the indentation shape.
Figure 24:
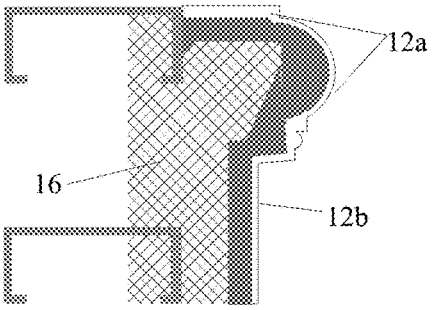
FIG. 24 is FIG. 23 with the 3D form removed and the polyurethane foam insulation layer applied to the backside of the backing layer.

An individual 3D form 23 is shown in FIG. 22 with the form's indentation shape 20 forming a window or door moulding on one side of a window or door opening 25. The 3D form 23 sits against a frame member 1 on one side and on top of a previously applied wall face 12*b* on the other side. The wall face 12*b* is supported by a previously applied backing layer 14 and a polyurethane spray foam insulation layer 16 that bonds the layers to other frame members 1. FIG. 23 shows FIG. 22 with the moulding's face layer 12*a* and backing layer 14 sprayed into the indentation shape 20 and connecting with the previously applied face layer 12*b* and backing layer 14. FIG. 24 shows FIG. 23 with the 3D form 23 removed and the polyurethane foam insulation layer 16 applied to the backside of the backing layer's 14.

In another embodiment special one-sided forms are used for a variety of different sprayed-in-place framed wall applications. Special one-sided wall forms include self-supporting forms and climbing forms and are in addition to other forms known in the art.

Figure 25:
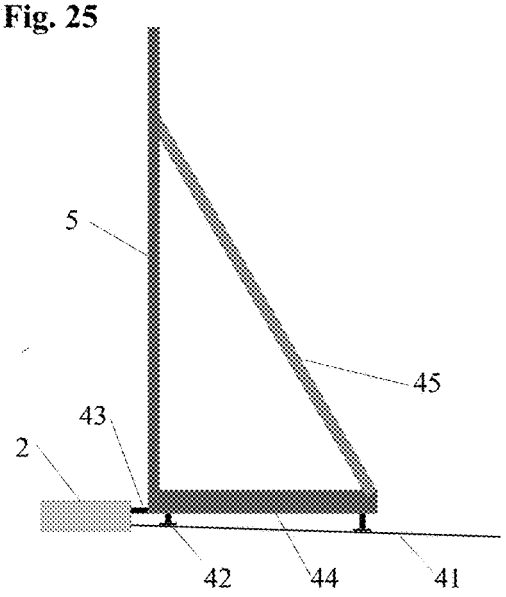
FIG. 25 shows a self-supporting form used to spray-in-place tall walls.

Self-supporting forms are comprehensive one-sided wall forms that support themselves horizontally and vertically. The forms are horizontally self-supporting by having the capability of being leveled and raised or lowered to the desired height. The forms are vertically self-supporting by having the capability of moving the form face into alignment, plumbed and braced. For example a "L" shaped form as shown in FIG. 25, has a vertical form face 5 attached to a horizontal base 44. The form is horizontally self-supporting by the base 44 that may be set upon any relatively flat ground or other surface 41 at or below the bottom elevation of the wall to be sprayed-in-place. The base 44 is then leveled and raised to position the form at its horizontal height. The leveling and raising may be done by leveling/height adjustment pads 42 attached to the base or by using blocking and/or shims.

Figure 26:
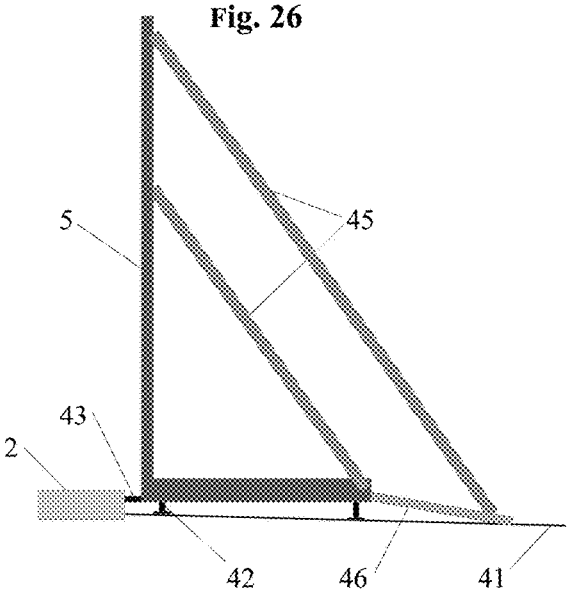
FIG. 26 shows the self-supporting form of FIG. 25 with additional braces.

The self-supporting form is vertically self-supporting by a form face 5 that is aligned, plumbed and braced by interaction with the base 44. For example a form face 5 that is perpendicular to the base 44 and adequately secured to the base 44 will be plumbed when the base 44 is perfectly level. Likewise, moving or rotating the base 44 will align a form face 5, secured to the base 44, with adjacent forms. Or the base 44 may support a mechanism that aligns the form face 5 without moving the base 44. Also shown in a bottom form 43 extending from the form face 5 to the floor 2. Relative to self-supporting bracing, the form face 5 is adequately braced with a brace 45 extending from the base 44, or as shown in FIG. 26 multiple braces 45 extending from the base 44 and optionally from a base extensions 46. Additional bracing may also be used.

The ground or other surface 41 must have sufficient bearing capacity to prevent the base 44 from sinking and support the form brace 45 to withstand wind. The base 44 may be held stationary by any method known in the art including it's own or added weight and pins driven into the ground or other surface. The form face 5 may be comprised of a single, individual form or several individual forms ganged together and secured to a frame. Due to the relatively large size and weight of the self-supporting forms, forklifts, cranes or similar type equipment is needed to move and handle the forms.

The self-supporting forms enable an efficient process for spraying-in-place all types of tall wall panels which are then attached to a wall frame. For example five forms with 200 square foot form faces can be moved into position, aligned and plumbed and used to spray-in-place 1,000 square foot of wall area per day.

Climbing forms are one-sided forms using for sprayed-in-place walls that are lift into place along the outside of taller buildings. For example cranes, jacks or hoists may be used to lift the forms from one story to the next. Once lifted to the desired height, the climbing forms are secured in position on the outside of a building in a variety of ways known in the art. For example the forms may be temporarily bolted and/or clamped to the building's superstructure, hung from the above floor or supported by mechanical arms extending outward from inside the building and through a window opening in the form.

Figure 27:
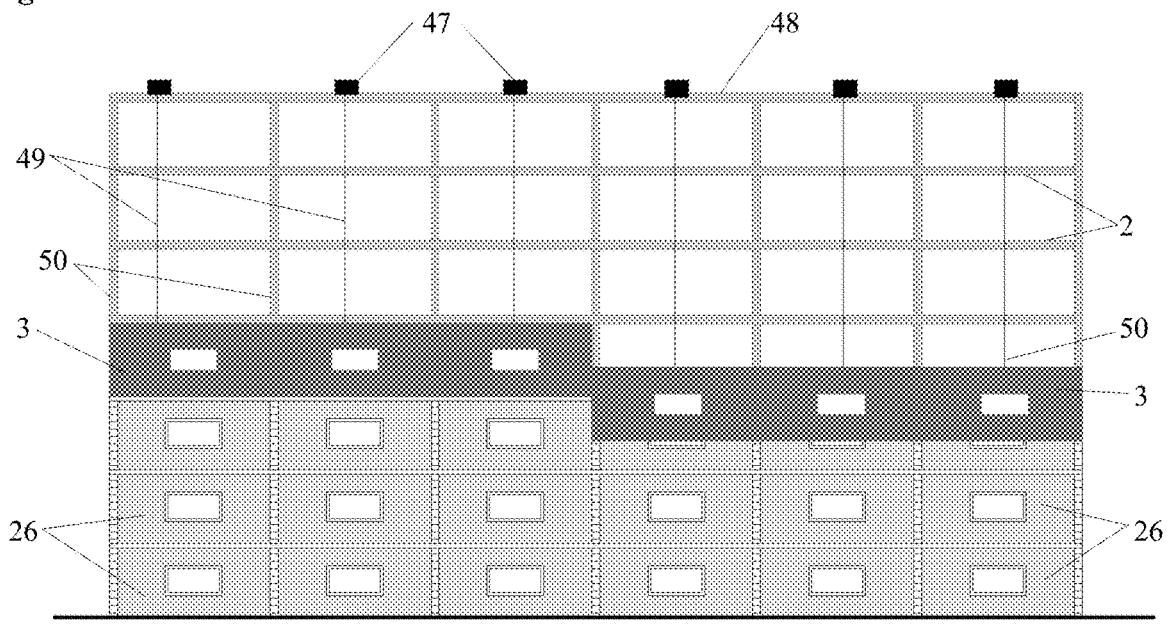
FIG. 27 shows a climbing form on the outside of a building under construction.

FIG. 27 shows a climbing form as a large one-sided form 3 being lift by a number of hoists 47 secured to the top of a building's roof 48. The hoists 47 have cables 49 attached to the forms 3 to raise or lower the forms 3. The forms 3 may be a large individual form or several individual forms ganged together. After the forms are secured, the wall panel's layers are sprayed-in-place and the wall panels are attached to a supporting wall frame (not shown) erected between the columns 50 and floors 2 shown in FIG. 27. Once the wall panel's layers are sufficiently cured, the form is released and hoisted to the next floor. As the forms are moved upward, a fully finished sprayed-in-place frame supported wall 26 is revealed.

In another embodiment, forms other than the herein defined wall forms may be attached to the wall forms as forming for related building or wall components. For example a soffit form may be attached to the wall forms and provide a form face for casting a soffit adjacent to a sprayed-in-place wall.

In another embodiment, all wall panel layers, including the insulation layer, are sprayed-in-place in the same day with the wall forms able to be removed on the following day. To accomplish this two important steps are necessary. First, the face layer must sufficiently harden to prevent its damage as the forms are removed. This is possible by using a fast setting material such as a polyurea coating that sets in seconds, a magnesium phosphate cement composition that sets in minutes or a calcium sulfoaluminate cement composition that sets in hours, among other fast setting materials known in the art. Second, the backing layer must be sufficiently dry to enable the sprayed polyurethane foam to bond to its backside. This also is possible using the above fast setting cements or a fast setting membrane that may be sprayed on the backing layer while it is still somewhat wet. Once the polyurethane foam is sprayed on the backing layer, the foam hardens in minutes and encapsulates and restrains the backing layer.

Construction of a sprayed-in-place framed wall involves multiple levels of people and/or organizations, including a property owner, an architect and/or engineer and one or more contractors. While one or more contractors will follow a process of constructing a sprayed-in-place framed wall in order to build it, that contractor will be directed to build it, directly or indirectly by the owner, architect, engineer and/or another contractor. Directing a contractor to build a wall includes hiring, contracting with, selecting, approving and/or supervising the contractor.

From the description above, a number of advantages of some embodiments of the stiffened, frame supported panel become evident:

(a) The inventive subject matter enables thin cementitious walls resulting in using far fewer building components and materials which reduces cost and speeds construction.

(b) The inventive subject matter enables spray polyurethane foam to be used to reinforce a thin concrete or other cementitious material used as a cladding and/or sheathing.

(c) The inventive subject matter discloses cementitious material with less abrasive aggregates to enable a wall panel face protruding seam to be easily sanded down to blend into the full wall face.

(d) The inventive subject matter uses a separate wall frame for load bearing purposes and thereby enables a concrete wall face and sheathing to be much thinner and free of steel rebar or wire mesh reinforcement.

(e) The inventive subject matter discloses a thin, sprayed-in-place cementitious wall that uses fewer material that are easily transported to and easily mixed on the job-site.

(f) The inventive subject matter enables continuous insulation and moisture barrier to the exterior of a frame by using anchors to attach a concrete wall panel to the frame.

(g) The inventive subject matter enables the uses of thin, lightweight and minimally braced wall forms due to using low pressure and/or low volume sprayed concrete.

(h) The inventive subject matter enables monolithic wall layers to be sprayed with few or no seams.

(i) The inventive subject matter enables a sprayed-in-place face layer with a multi-colored appearance created by spraying different colored material(s) in a variety of patterns.

(j) The inventive subject matter enables wall face protrusions such as moulding, quoins and bands created from wall forms with three dimensional form faces.

(k) The inventive subject matter discloses stays to temporarily support and restrain a thin, vertical cementitious wall panel until it hardens and is fixed to a frame.

Although the description above contains many specifications, these should not be construed as limiting the scope of the embodiments but as merely providing illustrations of some of several embodiments. Thus the scope of the embodiments should be determined by the appended claims and their legal equivalents, rather than by the examples given.

What I claim is:

1. A sprayed-in-place framed wall comprising a. a wall frame dependent, stationary wall panel comprised of one or more cementitious layers sprayed-in-place, while restrained with a stay, against one or more wall forms with a first layer having an exposed, form finished wall face from said wall forms, and b. said wall frame comprised of frame members and is permanently attached to a floor and spaced a distance apart from and fixed to said cementitious layers by a plurality of anchors and/or an insulation layer and said wall frame is attached to the backside of said wall panel to support and restrain said wall panel and to comprise a sprayed-in-place framed wall.

2. The sprayed-in-place framed wall of claim 1 wherein said wall face includes a sprayed-in-place 3D protruding shape.

3. The sprayed-in-place framed wall of claim 1 wherein a wall covering is attached to said frame's interior side.

4. The sprayed-in-place framed wall of claim 1 wherein the total thickness of said cementitious layers is less than 2" thick.

5. The sprayed-in-place framed wall of claim 1 wherein said insulating layer is comprised of spray polyurethane foam exterior to said frame.

6. A method for constructing a sprayed-in-place framed wall comprising a. positioning one or more one-sided, reusable wall forms on or near a floor and said forms have a form face facing inward, and b. spraying-in-place one or more cementitious layers against said form face and restrained with a stay, to create a wall frame dependent, stationary wall panel with a first layer of said one or more cementitious layers having a wall face, form finished by said form face, and c. attaching a wall frame to the backside of said wall panel and said wall frame spaced a distance apart from and fixed to said one or more cementitious layers by a plurality of anchors and/or an insulation layer and said wall frame is comprised of frame members permanently attached to said floor so that said wall frame supports and restrains said wall panel to create said sprayed-in-place framed wall, and d. removing said forms from said wall panel after said one or more cementitious layers have sufficiently cured to expose said wall face, whereby said framed wall was sprayed in place.

7. The method for constructing the sprayed-in-place framed wall of claim 6 wherein one or more of said frame members being installed into said frame after said first layer is sprayed-in-place.

8. The method for constructing the sprayed-in-place framed wall of claim 6 wherein said insulating layer is comprised of spray polyurethane foam exterior to said frame.

9. The method for constructing the sprayed-in-place framed wall of claim 6 wherein said wall face includes a sprayed-in-place 3D protruding shape.

10. The method for constructing the sprayed-in-place framed wall of claim 6 wherein a mesh is embedded in one or more layers of said wall panel.

11. The method for constructing the sprayed-in-place framed wall of claim 6 wherein at least one said form overruns an outside corner.

12. The method for constructing the sprayed-in-place framed wall of claim 6 wherein reinforcement strips are embedded in one or more said layers.

13. The method for constructing the sprayed-in-place framed wall of claim 6 wherein said wall panel has a membrane.

14. The method for constructing the sprayed-in-place framed wall of claim 6 wherein at least one said frame member is shaped to incorporate one or more said anchors.

15. The method for constructing the sprayed-in-place framed wall of claim 6 wherein the total thickness of said cementitious layers is one inch or less in thickness.

16. The method for constructing the sprayed-in-place framed wall of claim 6 wherein returns are formed and sprayed-in-place.

17. The method for constructing the sprayed-in-place framed wall of claim 6 wherein said cementitious material is comprised of a cement.

18. The method for constructing the sprayed-in-place framed wall of claim 6 wherein said wall forms are self-supporting forms.

19. The method for constructing the sprayed-in-place framed wall of claim 6 wherein said wall forms are climbing forms.

* * * * *